United States Patent [19]

Roth et al.

[11] Patent Number: 5,020,719

[45] Date of Patent: Jun. 4, 1991

[54] DISPENSING CONTAINER

[75] Inventors: Michael C. Roth, Naugatuck; Walter J. Buttrick, Brookfield, both of Conn.

[73] Assignee: Chesapeak Display & Packaging Company, Winston-Salem, N.C.

[21] Appl. No.: 213,599

[22] Filed: Jun. 30, 1988

[51] Int. Cl.[5] ..... B65D 5/36; B65D 5/38

[52] U.S. Cl. ..... 229/122.1; 206/620; 221/302; 229/913

[58] Field of Search ..... 229/11, 20, 122.1, 904.1, 229/913; 206/45.15, 123, 124, 620, 628, 634; 221/302, 305, 306; 222/541, 550, 563

[56] References Cited

U.S. PATENT DOCUMENTS

| | | | |
|---|---|---|---|
| 422,032 | 2/1890 | Munson | 206/124 |
| 980,625 | 1/1911 | Gamble | 206/124 |
| 998,702 | 7/1911 | Lichtig et al. | 206/124 |
| 1,000,624 | 8/1911 | Pexton | 229/122.1 |
| 1,378,533 | 5/1921 | Fitzgerald | 229/122.1 |
| 1,585,980 | 5/1926 | Hatt | 206/124 |
| 1,645,577 | 10/1927 | Pillsbury | 229/122.1 |
| 2,235,473 | 3/1941 | Blinstrub | 206/124 |
| 2,770,408 | 11/1956 | Lindeberg | 229/122.1 |
| 2,891,711 | 6/1959 | Early | 229/122.1 |
| 3,161,341 | 12/1964 | Farquhar | 229/122.1 |
| 3,207,380 | 9/1965 | Hennessey | 229/122.1 |
| 3,593,908 | 7/1971 | Desmond et al. | 229/122.1 |
| 3,900,104 | 8/1975 | Harned | 229/19 |
| 4,091,984 | 5/1978 | McFarland | 229/23 BT |
| 4,138,052 | 2/1979 | Torigian | 229/122.1 |
| 4,186,866 | 2/1980 | Zicko | 229/122.1 |
| 4,283,000 | 8/1981 | White | 229/122.1 |
| 4,416,410 | 11/1983 | Herrmann | 229/620 |
| 4,658,984 | 4/1987 | Brunner | 221/305 |
| 4,805,765 | 2/1989 | Barrett et al. | 229/20 |

*Primary Examiner*—Gary E. Elkins

*Attorney, Agent, or Firm*—Bell, Seltzer, Park & Gibson

[57] ABSTRACT

A dispensing container has a main body portion with opposing side, back and front and top and bottom walls. The lower portion of the front wall is rupturable and removable from the front wall to form an access opening to gain access to the interior of the main body. A slideable tray rests on the bottom wall and is slidably movable to an extended position where the tray is withdrawn through the access opening. The tray has front, bottom, back and sidewall panels. An abutment member carried by each sidewall panel is adapted to engage the inner surface of the front wall adjacent the access opening for preventing withdrawal of the tray completely from the main body. The tray back wall panel extends upwardly a greater height than the other panels of the tray and includes thereon a plurality of score lines extending widthwise of the tray for serving to guide the contents of the tray toward the front panel of the tray.

3 Claims, 2 Drawing Sheets

DISPENSING CONTAINER

FIELD OF THE INVENTION

This invention relates to containers having means for readily dispensing contents of the container and more particularly to containers having a dispensing tray slidably movable from a position within the body to an extended dispensing position.

BACKGROUND OF THE INVENTION

It has been common to provide packages which serve as dispensing containers. Such packages permit both shipment and subsequent controlled dispensing of the contents of the container. Common examples include match boxes, grain dispensers, and candy dispensers. With the exception of the match box style design where a tray is slidably movable outwardly from a main body, most dispensing containers include a tray or other dispensing means which pivotably moves outwardly from a main container body. By constructing the tray so that means carried by the tray engage a wall of the main body to limit the amount of tray pivot, a pivotable tray bin is established to gain access to the contents of the container. Such designs include those disclosed in U.S. Pat. Nos. 2,235,473; 3,593,908; and 4,283,000.

Although these designs provide a combination dispenser and container, it is believed they are limited in their use. If the contents of the container are heavy, the excessive weight exerted against the tray front wall can unbalance the container. In addition, a pivoting tray limits the amount of dispensing volume near the lower portion of the tray where the container contents usually are located making it difficult to manually grasp the contents contained within the tray.

To minimize the aforesaid problems, one dispensing container design disclosed in U.S. Pat. No. 1,645,771 to Pillsbury includes a pivoting tray which slidably moves outwardly from a main container body so that the front portion of the tray forms a tray bin having an enlarged opening. In addition, a curved, upwardly extending tray back wall serves to guide the contents of the container forward facilitating their withdrawal. However, complex means is disclosed for locking the tray in its pivoted, open position, and a potential imbalance is created by the fully opened tray.

It is therefore an object of this invention to provide a dispensing container having a tray which moves in a non-pivoting manner outwardly from a main container body toward an extended position and which includes means preventing withdrawal of the tray completely from the body.

It is another object of this invention to provide a dispensing container having a tray slidably movable outwardly from a main container body and means serving to guide the contents of the tray forward to facilitate dispensing thereof.

SUMMARY OF THE INVENTION

These and other objects and advantages of the present invention are accomplished by a dispensing container which includes a main body portion having opposing side, back and front and top and bottom walls with lower portions of the front wall being rupturable for removal of a portion of the front wall from the main body portion to form an access opening thereat for gaining access to the interior of the body portion. A slideable tray is positioned within the body portion with the tray resting on the bottom wall of the body portion and slidably movable from a position within the body portion to an extended position where the tray is withdrawn through the access opening in the lower portion of the front wall of the body portion for gaining ready access to the contents of the tray. The tray has side panels serving as tray side walls. An abutment member is carried by each of the tray side panels and is adapted to engage the inner surface of the front wall adjacent the access opening for preventing withdrawal of the tray completely from the main body.

In the preferred embodiment, the rear portions of the tray side panels are of a greater height than the front portions of the tray side panels for preventing spillage of the tray contents from areas adjacent the access opening. The tray also has front, back, and bottom wall panels with the back wall panel extending upwardly a greater height than the other panels of the tray. The back wall panel also has a plurality of score lines extending widthwise of the tray for serving to guide the contents of the tray toward the front wall panel of the tray. The bottom, side and back wall panels also are of single-layer panel thickness and the front wall panel is of a multi-layer panel thickness.

BRIEF DESCRIPTION OF THE DRAWINGS

Some of the objects and advantages of the present invention having been stated, others will be more fully understood from the detailed description which follows and by reference to the accompanying drawings in which.

DETAILED DESCRIPTION OF THE PREFERRED EMBODIMENT

Figure 1:
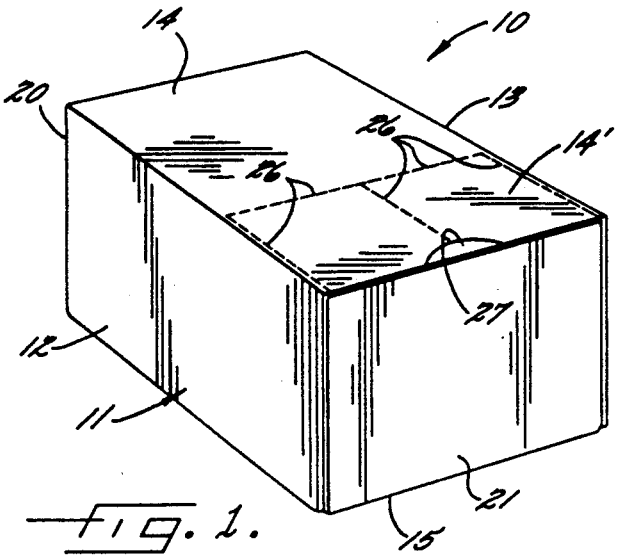
FIG. 1 is an isometric view of the dispensing container before rupture of the front wall.
Figure 4:
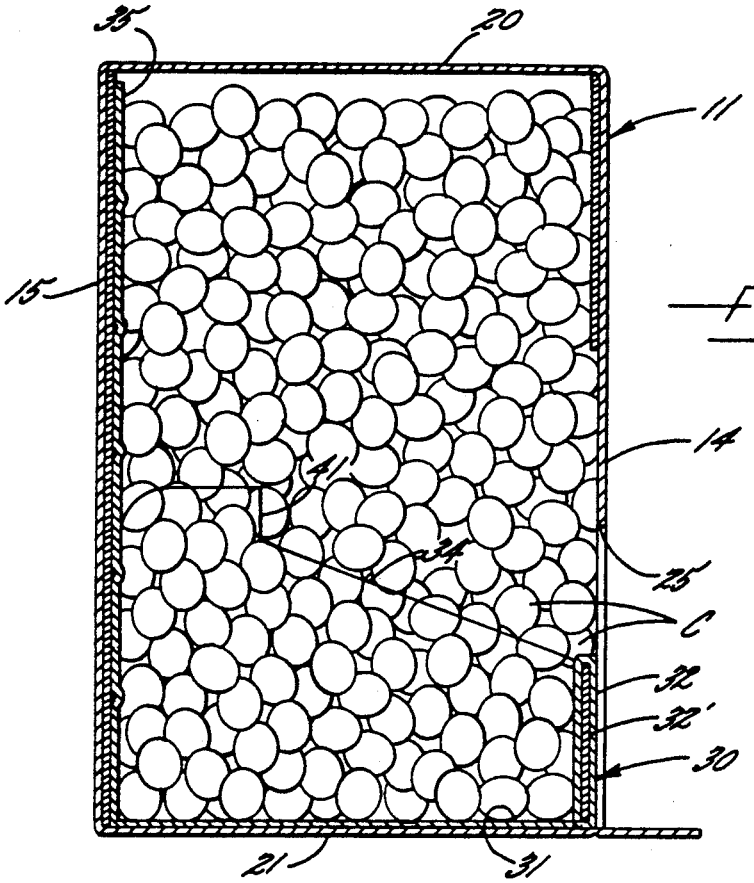
FIG. 4 is a sectional view of the dispensing container taken along line 4—4 of FIG. 2.
Figure 5:
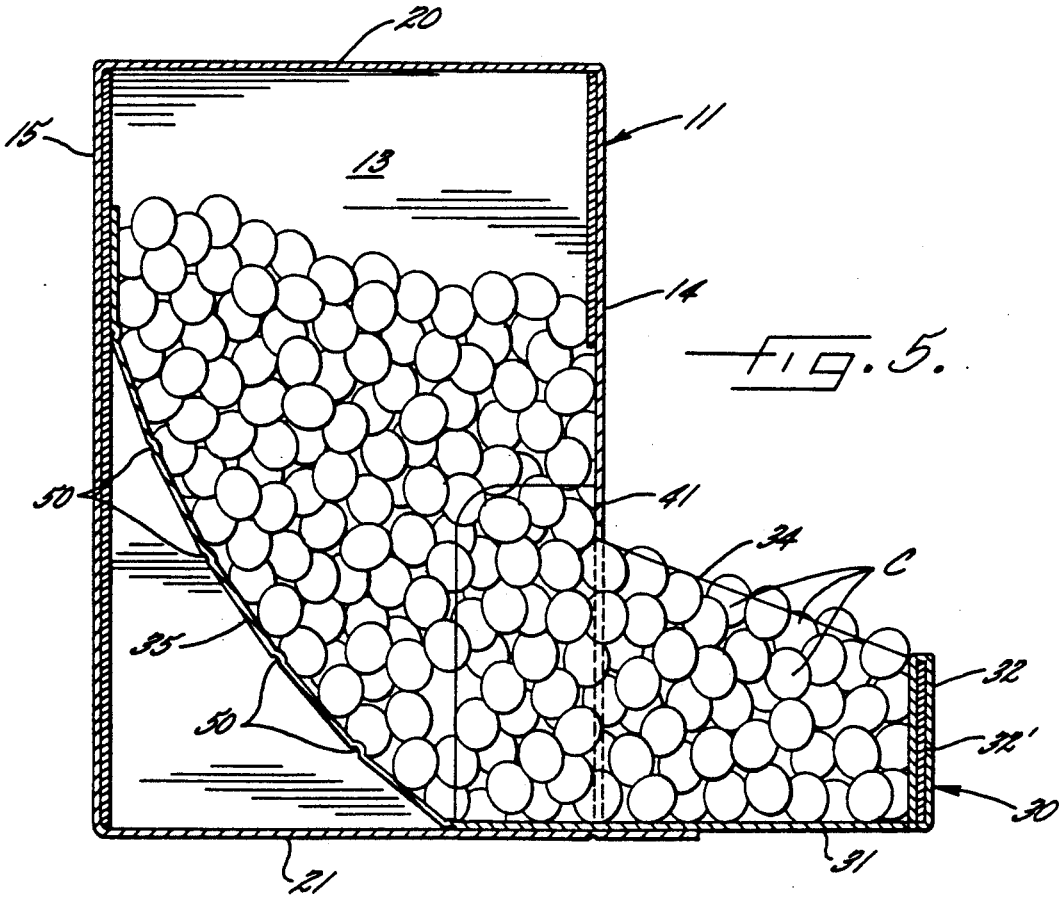
FIG. 5 is a sectional view of the dispensing container taken along line 5—5 of FIG. 3.

Referring now to the drawings, and more particularly to FIG. 1, the dispensing container according to the present invention is shown. The container 10 includes a main body portion 11 which can be constructed from a variety of materials. Preferably, it is constructed from cardboard or other similar corrugated material to simplify manufacturing and reduce its overall cost. The main body portion has opposing side walls 12, 13, opposing front and back walls, 14, 15 and opposing top and bottom walls 20, 21 giving the body portion 11 a substantially rectangular configuration. Although any number of methods can be used to produce the body portion, e.g., gluing individual panels or tabs together, it has been found that producing the body portion from a one piece cardboard blank (not shown) is efficient since the walls 12, 13, 14, 15, 20 and 21 quickly can be folded together and, in addition, minimal scrap is produced. Once constructed, the body portion 11 has a double wall thickness along one side 13 and portions of the front and back 14, 15 to add rigidity and strength to the body portion (FIGS. 4 and 5). In the preferred embodiment, the blank is designed so that the body portion is constructed where the front wall 14 is folded over the body portion 11 last. As will be described in detail hereafter, this facilitates filling of the container 10 with those contents which are to be dispensed, e.g., candies and other small objects.

Figure 2:
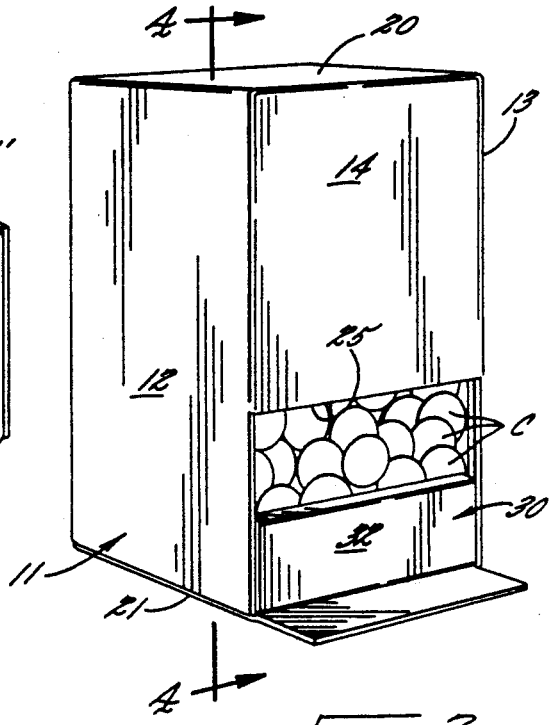
FIG. 2 is an isometric view of the dispensing container after rupture of the front wall.

As shown in FIGS. 1 and 2, lower portions 14' of the front wall are rupturable for removal of a portion of the front wall from the main body portion 11 to form a rectangular access opening 25 thereat for gaining access to the interior of the body. A series of perforated tear lines 26 are located along the front wall 14 and terminate in a tab 27 located at the lower medial portion of the front wall. By lifting the tab 27, a small finger access is created on the front wall 14. The lower portions 14' of the front wall can then be torn along the perforated tear lines 26 and those sections removed therefrom to create the access opening 25.

Figure 3:
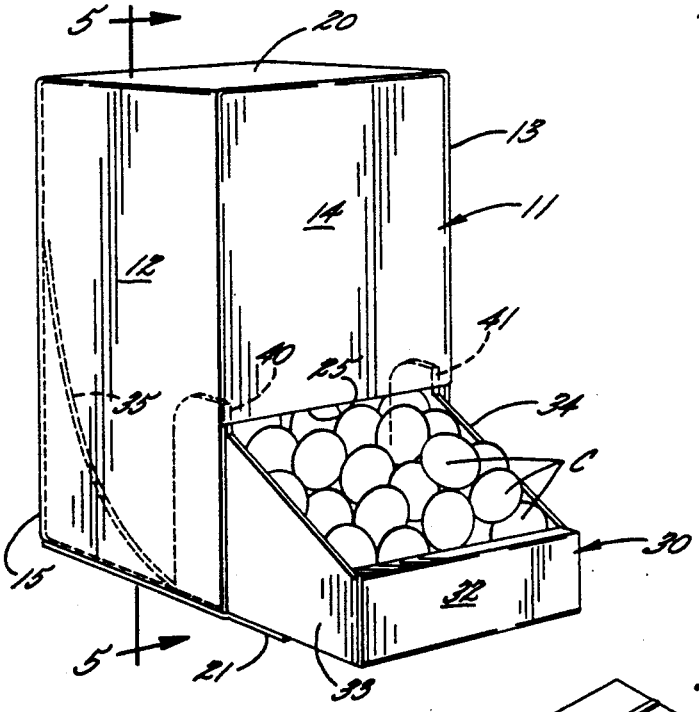
FIG. 3 is an isometric view of the dispensing container with the slideable tray moved to an extended position.

Resting on the bottom wall 21 of the body portion 11 is a dispensing tray 30 slideable within the main body portion and slidably movable from a position within the body portion to an extended position where the tray is withdrawn through the access opening 25 in the lower portion 14' of the front wall (FIG. 3). When the tray is moved to its extended position, the contents C of the container 10 are readily accessible since a portion of them are contained within the tray 30. As will be hereinafter described in detail, the structure of the tray 30 facilitates dispensing so that the tray 30 continually is replenished as the container contents C are withdrawn through the tray.

Figure 6:
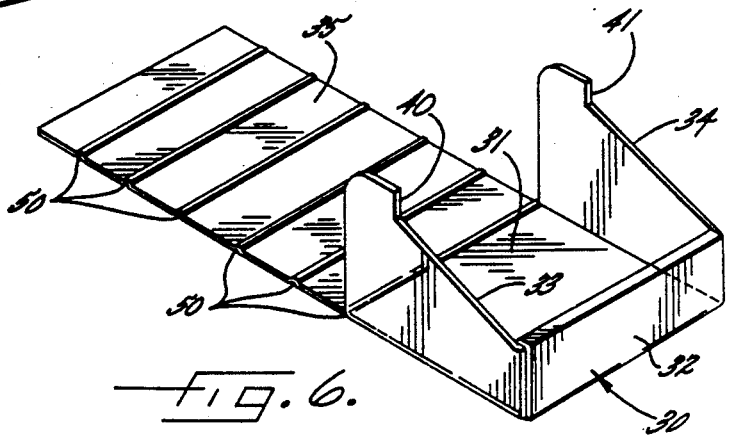
FIG. 6 is an isometric view of the tray removed from the dispensing container and showing the score lines on the back wall panel.

As shown in FIG. 6, the tray 30 has a bottom wall panel 31, a front wall panel 32 connected to the frontal portion of the bottom wall panel, opposing side wall panels 33, 34 serving as tray side walls connected to the side portion of said bottom wall panel, and a back wall panel 35 hingedly connected to the rearmost portion of the back wall panel. Similar to the construction of the main body 11, the tray also can be constructed from a variety of different materials using different methods. However, like the construction of the body portion 11, constructing the tray from a one piece cardboard blank (not shown) has been found to be economically and functionally practical. In the preferred embodiment, the tray front wall panel 32 also is of lesser height than the height of the access opening 25 (FIG. 2). Thus, the front wall panel 32 can be manually grasped to withdraw the tray 30 from the container 10. Also, it is of multi-layer thickness to provide additional strength thereto (FIG. 5). In the illustrated embodiment, the front wall panel 32 is folded upon itself and extends over middle tabs 32' (FIG. 5).

To prevent complete withdrawal of the tray 30 from the container 10, rear portions of the tray sidewall panels 33, 34 are of greater height than the height of the access opening 25 to provide on each of the sidewall panels abutment members 40, 41 which are adapted to engage the inner surface of the body front wall 14 adjacent the access opening 25 and allow about ⅔ of the length of the tray to be withdrawn from the main body portion (FIG. 5). Starting at the abutment members 40, 41, wall panels 33, 34 taper downwardly to the front wall panel 32 to provide additional tray volume for preventing spillage of the tray contents C from areas adjacent the access opening 25 (FIGS. 3 and 6). If the height of the side wall panels 33, 34 were the same height along the side wall length from the front wall panel 32 to the abutment members 40, 41 then no restraint would be provided to prevent the container contents C from spilling from the sides of the tray 30 at those areas adjacent the access opening 25.

In the preferred embodiment, the back wall panel 35 extends upwardly a distance several times greater than the height of the tray front panel 32 which as best seen in FIG. 4 is substantially the height of the overall container 10. Extending widthwise of the back wall panel 35 are included a plurality of score lines 50 for facilitating the uniform curvature of the back wall and thus the guidance of the contents of the tray toward the front wall panel 32 of the tray 30.

When the container 10 is filled, the container contents C press the back wall panel 35 against the body back wall 15 ( FIG. 4). When the tray 30 is slideably moved to its extended position through the access opening 25, the container contents C still press against the back wall panel 35 of the tray thus serving as a chute. The score lines 50 extending widthwise of the tray back wall panel 35 permit the back wall panel to sag and create an inclined wall or chute directed from the top portion of the body back wall 15 to the bottom wall panel 31 of the tray 30 (FIG. 5). Thus, the contents C are guided downwardly toward the front wall panel 32 of the tray 30 to facilitate dispensing thereof.

In addition, the resiliency of the back wall panel 35 facilitates withdrawal of the tray 30 from the body 11. If the back wall panel 35 was rigidly secured to the tray bottom wall panel 31, the tray could not be withdrawn since the container contents C would prevent forward movement of the tray back wall panel 35. Although this problem could be alleviated by decreasing substantially the height of the tray back wall panel 35, other difficulties would be encountered since some of the container contents C would fall behind the tray 30 when the tray was extended. In addition, if the container 10 is to be stored or moved, the tray 30 may have to be inserted back into the container 10 to facilitate handling. Candies or other small objects trapped behind the tray 30 would make insertion of the tray back into the container difficult.

As noted before, filling of the container 10 is facilitated since the body front wall 14 is folded onto the body 11 last. The tray can be placed within the body 11 before securing the body front wall 14 thereon. With the container body 11 flat, its front wall 32 unsecured and the tray 30 contained therein, small candies or other articles can be inserted therein. The front wall 14 can then be secured to the container body 11 by means conventional to the packaging industry.

To use the dispensing container 10, the container front walls 14 are ruptured along the perforated tear lines 26. The tray front wall panel 32 is grasped and pulled to extend the tray 30. As the tray 30 is extended, the back wall panel 30 folds along the score lines 50 to maintain a gently curved and inclined back wall which facilitates movement of the container contents C toward the front wall panel 32. During dispensing, the tray 30 continually is replenished since container contents C are guided along the curved and inclined back wall panel 35 toward the front wall panel 32 of the tray 30.

The foregoing embodiment is to be considered illustrative rather than restrictive of the invention and those modifications which come within the meaning and range of equivalents of the claims to be included therein.

That which is claimed is:

1. A dispensing container comprising a substantially rectangular main body potion having opposing side, back and front and top and bottom walls, means provided on a lower portion of the front wall for facilitating removal of a portion of the front wall from the main body portion to form an access opening thereat for gaining access to the interior of the body portion, a slidable tray within said body portion with said tray resting on the bottom wall of said body portion and slidably movable from a position within the body portion to an extended position wherein said tray is withdrawn through the access opening in the lower portion of the front wall of the body portion for gaining ready access to any contents in the tray, said tray having side panels serving as tray side walls and a back wall panel serving as a chute for facilitating dispensing of any contents from the container when the tray is in an extended position, abutment means carried by said tray side panels and adapted to engage an inner surface of said front wall adjacent the access opening for preventing withdrawal of said tray completely from said main body wherein said back wall panel includes a plurality of score lines extending widthwise of the tray to guide the contents of the tray toward the front panel of the tray.

2. The dispensing container as claimed in claim 1 wherein said bottom, side and back wall panels are of single-layer panel thickness, and said front wall panel is of multi-layer panel thickness.

3. A dispensing container comprising a substantially rectangular main body portion having opposing side, back and front and top ad bottom walls, means provided on a lower portion of the front wall for facilitating removal of a portion of the front wall from the main body portion to form an access opening thereat for gaining access to the interior of the body portion, a slidable tray within said body portion with said tray resting on the bottom wall of said body portion and slidably movable from a position within the body portion to an extended position wherein said tray is withdrawn through the access opening in the lower portion of the front wall of the body portion, said tray having a bottom wall panel with front, side and rear portions, a front wall panel connected to the front portion of said bottom wall panel, opposing side wall panels serving as tray side walls connected to the side portions of said bottom wall panel, abutment means carried by said tray side wall panels and adapted to engage an inner surface of said front wall adjacent the access opening for preventing withdrawal of said tray completely from said main body, and a back wall panel hingedly connected to the rearmost portion of said tray bottom wall panel and serving as a chute for facilitating dispensing of any contents from the container when the tray is in an extended position wherein said back wall panel has a plurality of score lines extending widthwise of the tray for facilitating guidance of any contents in the tray toward the front wall panel of said tray.

* * * * *